United States Patent [19]

Ryan et al.

[11] Patent Number: 4,558,743

[45] Date of Patent: Dec. 17, 1985

[54] STEAM GENERATOR APPARATUS AND METHOD

[75] Inventors: Norman W. Ryan; Angelo Peperakis, Jr., both of Salt Lake City, Utah

[73] Assignee: University of Utah, Salt Lake City, Utah

[21] Appl. No.: 509,285

[22] Filed: Jun. 29, 1983

[51] Int. Cl.[4] ..... E21B 43/24

[52] U.S. Cl. ..... 166/303; 166/59; 122/31 R; 431/160; 431/173; 431/243

[58] Field of Search ..... 166/59, 303, 302; 431/243, 160, 11, 173; 122/31 R, 5.5 A; 126/360 A, 360 R

[56] References Cited

U.S. PATENT DOCUMENTS

| | | | |
|---|---|---|---|
| 2,368,827 | 2/1945 | Hanson et al. | 431/173 |
| 3,073,683 | 1/1963 | Switzer et al. | 122/31 R |
| 3,456,721 | 7/1969 | Smith | 166/59 |
| 3,951,584 | 4/1976 | Thekdi | 431/173 X |
| 3,980,137 | 9/1976 | Gray | 166/303 |
| 3,993,431 | 11/1976 | Oda et al. | 431/160 X |
| 4,077,469 | 3/1978 | Hamrick et al. | 166/59 |
| 4,120,640 | 10/1978 | Martin | 431/173 X |
| 4,237,973 | 12/1980 | Todd | 166/59 |
| 4,243,098 | 1/1981 | Meeks et al. | 166/59 |
| 4,385,661 | 5/1983 | Fox | 166/59 |
| 4,456,068 | 6/1984 | Burrill, Jr. et al. | 166/303 |
| 4,459,101 | 7/1984 | Doherty | 431/353 |
| 4,463,803 | 8/1984 | Wyatt | 166/59 |

*Primary Examiner*—James A. Leppink
*Assistant Examiner*—Hoang C. Dang
*Attorney, Agent, or Firm*—Workman, Nydegger & Jensen

[57] ABSTRACT

A steam generator for producing steam in a confined space such that it can be positioned in a borehole for use in secondary and tertiary recovery of hydrocarbons. Fuel is injected axially into a combustion chamber having a reduced orifice in the bottom thereof and oxygen is introduced tangentially from a plurality of ports in the top of the combustion chamber to create a stable vortex flame. A portion of the walls of the combustion chamber are formed from a porous, sintered stainless steel cylinder through which water is pumped to cool the walls of the chamber and to form steam. The combustion products are mixed with a water mist in a steam generating section to form steam.

37 Claims, 5 Drawing Figures

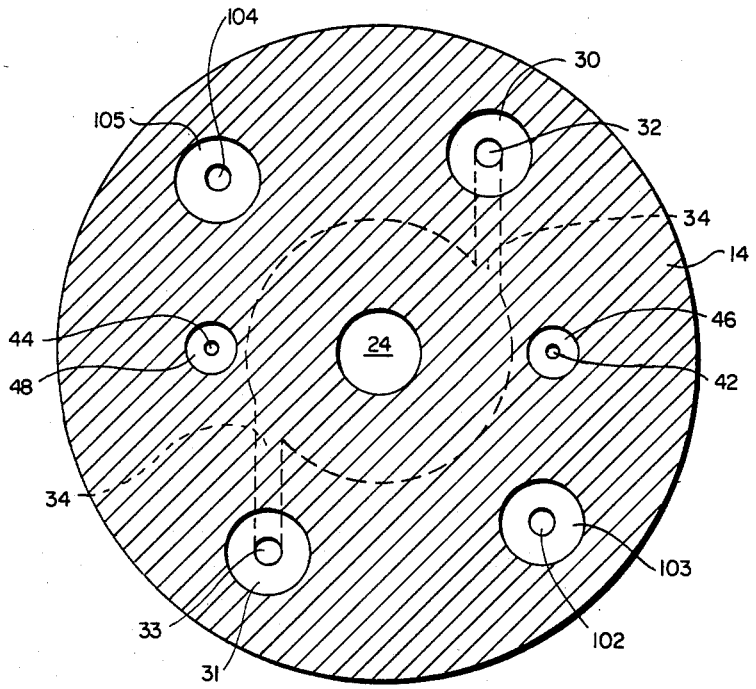
Fig. 2
Fig. 3
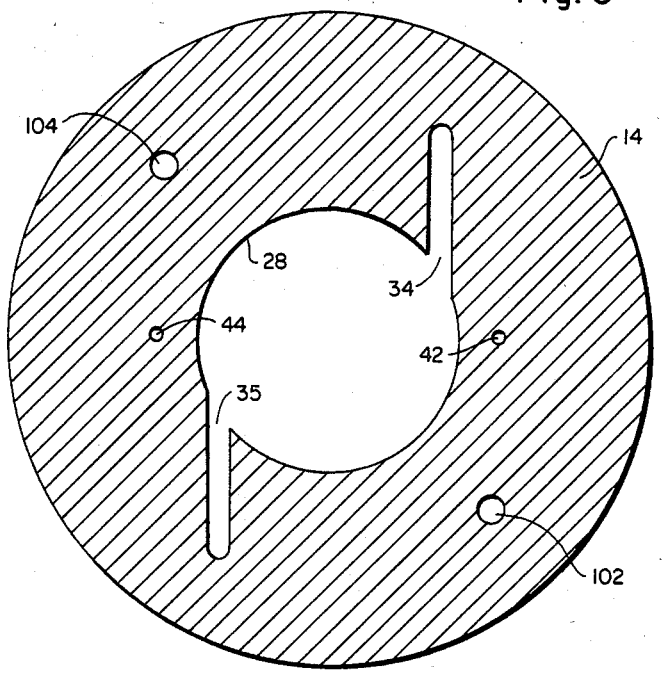

STEAM GENERATOR APPARATUS AND METHOD

BACKGROUND

1. Field of the Invention

The present invention relates to steam generators utilized in secondary and tertiary recovery of petroleum products and, more particularly, to a novel, compact steam generator such as can be utilized in conventional well casings or other confined areas.

2. The Prior Art

Petroleum, or crude oil, is found throughout the world and is generally located in subterranean pools formed in porous rock formations, such as sandstone. The liquid petroleum fills the voids between the various particles of sand or other rock that makes up the formation.

The physical characteristics of petroleum vary greatly depending upon the particular compounds which make up the petroleum deposit. Some petroleums are quite light and have a low viscosity such that they can easily flow through the formation and be pumped from the ground. Other petroleum reserves are much more viscous and are difficult to pump at ambient temperatures. Thus, the physical characteristics of the petroleum effect the ease with which the petroleum can be recovered.

Petroleum deposits are generally accompanied by deposits of natural gas. This natural gas can either be dissolved within the petroleum or it can form a small pocket on top of the petroleum pool. When an oil well is drilled, the gas pressure within the deposit is often times sufficient to force the petroleum to flow into the production well and up to the surface where it is recovered. As the gas pressure decreases through either expansion or recovery of the gas itself, it is often necessary to add pumps to the oil wells to assist in bringing the oil to the surface.

The utilization of the naturally existing gas pressures and the utilization of pumps are generally referred to collectively as primary recovery of oil. When pumping fails to provide sufficient stimulus to remove the oil from the ground, secondary and tertiary methods of oil recovery are often utilized.

One method of secondary recovery involves reinjecting natural gas into the formation to supply pressure to drive the oil up through the well. Often times, the oil remaining within the formation, after primary recovery is completed, has a high viscosity such that the mere addition of pressure is insufficient to cause it to flow to the well where it can be recovered. Accordingly, various methods of secondary recovery including those utilizing thermal stimulation have been devised to reduce the viscosity of the oil and enhance its ability to flow. Of the various thermal techniques which have been developed, steam injection has generally been demonstrated to be the most economical and most widely used.

According to the presently accepted techniques used in the industry, steam is generated above ground and is injected into the well casing where it is forced down into the petroleum-containing formation; the steam can then heat the petroleum to lower its viscosity. Although this process is widely utilized, it has several distinct disadvantages.

First, when the steam is injected into the well casing at the surface, enormous amounts of heat are lost as the steam passes down through the casing to the oil-bearing formation; this is often aggravated because many petroleum bearing formations are located thousands of feet below the surface of the ground. Thus, the effectiveness of the steam in reducing the viscosity of the oil is substantially lessened.

Second, depending on the process used for steam generation, heat losses to hot stack gases may be large, thus decreasing the overall thermal efficiency of the process.

Third, with all steam generators, it is necessary to burn some type of fuel to provide the necessary heat to creat the steam. Most fuels, unless they are thoroughly refined, contain compounds which create pollutants and thus, surface steam generators must be equipped with emission control devices which are costly and add to the expense of the operation.

Because of the disadvantages associated with above ground steam generators, many attempts have been undertaken to develop a down-hole steam generator. With down-hole generators, the steam is produced in the well near the formation where it is to be used, thereby reducing the amount of heat which is lost to surrounding formations and thereby improving the efficiency of the system. A second advantage of down-hole steam generators is that the noxious combustion products are generally discharged into the oil bearing formation where many of them are absorbed by the surrounding rock or become entrapped in the formation. Thus, the pollution problem is lessened to a great extent. Additionally, the combustion products formed during the creation of the steam contain a significant amount of carbon dioxide which is ultimately injected into the oil bearing formation where it is absorbed by the petroleum. Carbon dioxide injection is currently an accepted industrial process for tertiary recovery of hydrocarbons.

In spite of the many advantages associated with down-hole steam generators, attempts to develop a successfully operating unit have been plagued with various problems. For example, many of the prior art devices have experienced flame instability where pressure fluctuations in the well or supply tubes cause the flame to extinguish.

Additionally, it has been found difficult to maintain the thermal integrity of the burner components of the prior art devices during use. The flame temperature is generally high enough that it can melt or crack the walls of the generator if some type of cooling is not supplied. Thus, if the water flow rate decreases, is uneven, or if the lines or valves become plugged, the flame can easily damage the burner components. If a problem develops with the down-hole steam generator, it is necessary to pull the entire unit from the well casing which, in deep wells, causes considerable time delays and significantly increases the expense of the operation.

Finally, many of the prior art devices have experienced problems because of the unreliability of the ignition systems. Thus, fuel, oxidant, and water are pumped into the hole without any steam being generated.

In view of the foregoing, it will be appreciated that what is needed in the art is a down-hole steam generator and method which has a reliable ignition which produces a compact, high-intensity flame, which has a reliable cooling system, and which can operate for substantial periods of time without having to be removed from the well for repair or replacement of worn or destroyed parts. Such an apparatus and method are disclosed and claimed herein.

BRIEF SUMMARY AND OBJECTS OF THE INVENTION

The present invention is directed to a compact steam generator and method which can be used for secondary and tertiary recovery of hydrocarbons such as petroleum, tar sands and oil shale.

A preferred embodiment of the present invention includes two main sections which are referred to as a combustion chamber and a steam generating section. The fuel is injected axially along the combustion axis through an atomizing nozzle. Two or more oxygen inlet ports are located around the periphery of the top of the combustion chamber such that oxygen exits therefrom. Thus, during operation a vortex flame is formed which is compact and stable. The flame is ignited by injecting a slug of pyrophoric liquid such as a metal alkyl into the combustion chamber with the fuel.

The walls of the combustion chamber are formed from a porous, sintered stainless steel cylinder and are surrounded by an annulus which is filled with water. As the water passes through the walls of the combustion chamber, the majority of it is vaporized by the radiant heat from the flame to produce steam. The walls of the combustion chamber also have a film of water on them which protects them from the intense heat of the flame.

The steam and the combustion products produced in the combustion chamber exit through an orifice in the bottom of the combustion chamber into the steam generating section. Spray nozzles positioned in the sides of the steam generating section create a water mist which is vaporized by the hot combustion products to form additional steam.

Finally, all of the steam and the combustion products are forced out of one-way valves in the sides of the steam generating section near the lower boundary of the chamber and into the hydrocarbon bearing formation.

It is, therefore, a primary object of the present invention to provide an apparatus and method to create steam which utilizes a compact, high intensity vortex-stabilized flame.

It is a further object of the present invention to provide a steam generator which utilizes a porous, sintered stainless steel wall in the combustion chamber such that water can pass therethrough to cool the walls and protect them from the intense heat of the flame.

Another object of the present invention is to provide a down-hole steam generator having a reliable ignition wherein the mixture is ignited by a pyrophoric liquid.

Still another object of the present invention is to provide a steam generator which is compact such that it can be utilized in conventional well casings or other space-limited compartments for extended periods of time without having to be removed from the well for repair or replacement of worn or destroyed parts.

These and other objects and features of the present invention will become more fully apparent from the following description and appended claims, taken in conjunction with the accompanying drawings.

BRIEF DESCRIPTION OF THE DRAWINGS

FIG. 2 is a cross-sectional view of the top of the steam generator of the present invention taken at the position indicated by line 2—2 of FIG. 1.

FIG. 3 is a cross-sectional view of the combustion section of the steam generator of the present invention taken at the position indicated by line 3—3 of FIG. 1.

DETAILED DESCRIPTION OF THE PREFERRED EMBODIMENTS

The present invention is directed to a novel steam generator which is compact so that it can be lowered down a borehole and positioned in a conventional well casing to produce steam near a hydrocarbon-bearing formation. The steam generator utilizes a vortex-stabilized flame to produce the heat necessary to vaporize water to form the steam which is utilized in secondary and tertiary recovery of hydrocarbon products such as petroleum.

Figure 1:
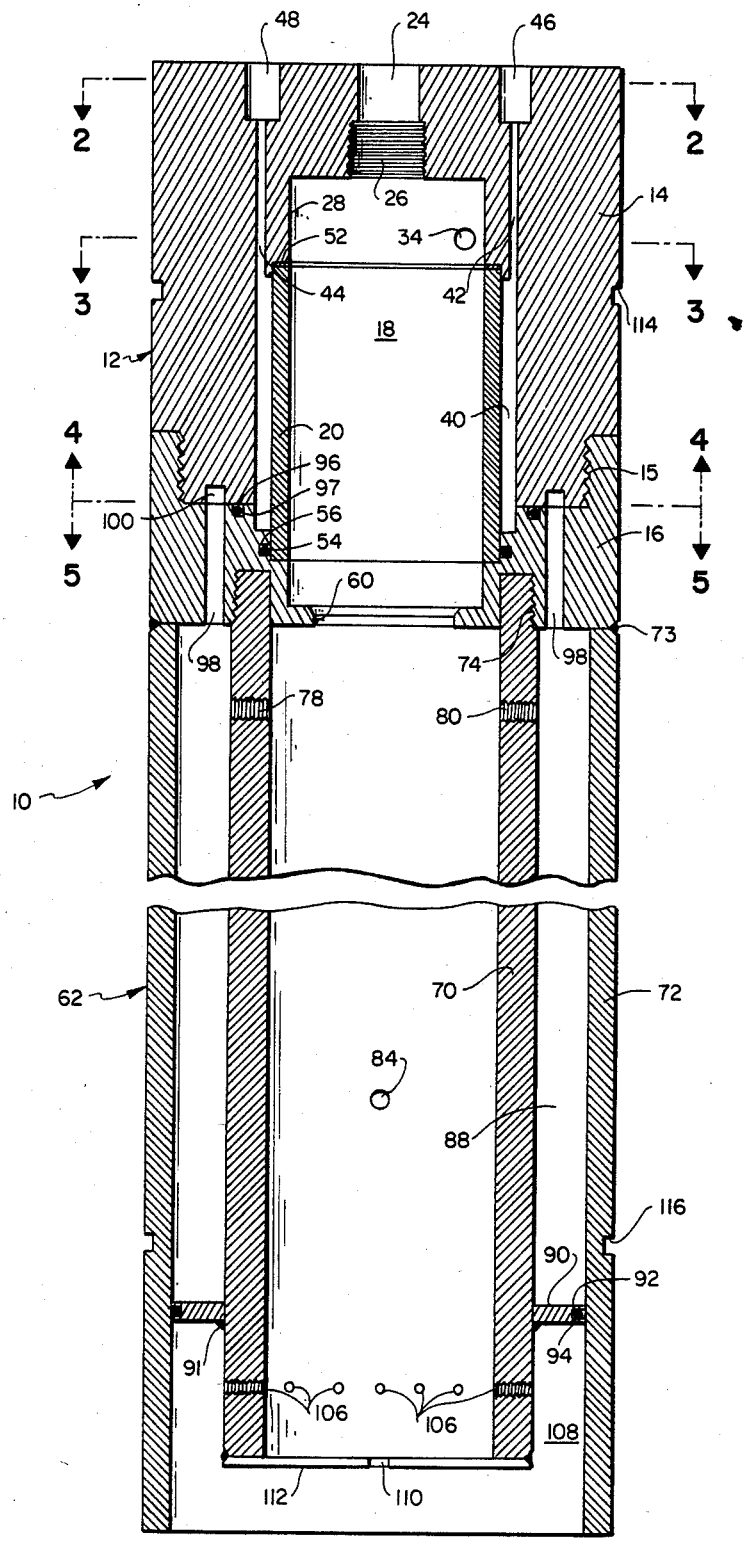
FIG. 1 is a cross-sectional view of a preferred embodiment of the down-hole steam generator of the present invention showing the combustion section and the steam generating section.

Reference is now made to the figures wherein like parts are referred to by like numerals throughout. With particular reference to FIG. 1, a steam generator constructed in accordance with the teachings of the present invention is illustrated in cross-section and is generally designated at 10. Steam generator 10 is cylindrical in shape and, in the preferred embodiment, has an outer diameter slightly less than six and one-half inches and an overall length of about ten feet. Thus, generator 10 can easily be positioned in any conventional well casings having an inside diameter greater than the cylinder.

The upper portion of steam generator 10 is referred to as the combustion or burner section and is generally designated 12. Combustion section 12 is formed from upper and lower housing members 14 and 16, respectively, which in the preferred embodiment are machined from a stainless steel rod and are screwed together at 15.

A reaction chamber 18 is axially formed within combustion section 12 to contain the flame, and the upper portion of reaction chamber 18 serves as a mixing chamber 28. As more fully discussed hereinafter, the fuel and oxygen are mixed in mixing chamber 28 and combustion begins to occur in this section.

Fuel enters the reaction chamber 18 through atomizing nozzle 26 in the top of housing member 14 and is sprayed axially downward into mixing chamber 28. Fuel nozzle 26 is connected by means of axial bore 24 formed in the top of housing member 14 to tubing (not shown) which extends up the borehole to a fuel pump. Steam generator 10 can be designed to utilize different types of fuel, such as natural gas or fuel oil.

The tubing for the fuel, oxygen, and water (which will be discussed hereinafter) should have diameters as large as physically possible to prevent large pressure drops as the reactants traverse the length of the borehole. Also, in the preferred embodiment, the tubes are welded to generator 10 to provide a more compact unit and to prevent any vibrations in the tubes from causing the lines to separate from the generator.

In the preferred embodiment, pure oxygen is used as the oxidant because if deep wells are considered, the cost of compressing and pumping compressed air exceeds that of using pure oxygen. Air is only about 20% oxygen and thus, the volume of air required is five times the required volume of oxygen. Additionally, studies of flow through rubblized beds of oil shale have shown that after a certain point is reached in increasing the gas flow rate through the bed, a further increase in the flow rate results in channeling. Accordingly, in order to avoid the possibility of channeling occurring in the hydrocarbon formations, it is advantageous to use oxygen rather than air as the oxidant to minimize the gas flow rate, thus obtaining maximum dispersion of the steam and heated gases. Either liquid or gaseous oxygen may be utilized; however, if liquid oxygen is utilized it must be allowed to form gaseous oxygen prior to its injection into the mixing chamber 28.

Referring now to FIG. 2, in the preferred embodiment oxygen is pumped down through tubing (not shown) and is injected into steam generator 10 through enlarged bores 30 and 31 formed in the top of upper housing member 14 of the steam generator. The oxygen then passes downwardly through reduced bores 32 and 33 where it makes a ninety degree turn (see also FIG. 3) and is injected into mixing chamber 28 through oxygen inlet ports 34 and 35. Bore 30-32, bore 31-33, and ports 34-35 through which the oxygen flows after it leaves the tube leading to the steam generator, must be equal in length and diameter to each other to assure a volumetrically symetric flow into the reaction chamber.

As the oxygen exits inlet ports 34 and 35, it tangentially encounters the fuel being atomized through nozzle 26. The oxygen is used to generate the vortex motion. As the fuel enters axially it encounters the vortex motion and the majority of the fuel has its direction changed from axial to tangential. The amount of fuel which changes direction depends on the fuel spray angle and the momentum of the fuel droplets relative to the momentum of oxygen. The larger the oxygen momentum relative to the fuel momentum the greater the amount of fuel which is swept up by the oxygen. This vortex motion and orifice 60 (discussed in greater detail hereinafter) in the bottom of the combustion section stabilize the resultant compact, high intensity flame in the reaction chamber. Thus, the present invention provides a means for overcoming the problem of flame instability encountered in the prior art devices. Also, inasmuch as a vortex flame is more stable than other types of flames, the likelihood that the flame will come in contact with and damage the walls of the combustion chamber is decreased.

In the embodiment illustrated in FIGS. 1–5, steam generator 10 has two oxygen inlet ports. However, additional oxygen inlet ports can be formed in mixing chamber 28 depending upon the size and heat requirements of the steam generator.

Referring again to FIG. 1, in the preferred embodiment inlet ports 34 and 35 are positioned about three-fourths of an inch below the bottom of fuel nozzle 26. If inlet ports 34 and 35 are too close to the outlet 27 (see FIG. 4) of nozzle 26, the oxygen will not impart sufficient tangential momentum to the fuel to create a flame having a stable vortex flow. However, inlet ports 34 and 35 should be spaced high enough that no fuel impinges the sides of mixing chamber 28. Accordingly, the placement of inlet ports 34 and 35 are dependent upon the angle of fuel spray. A wide angle of fuel spray requires the oxygen ports to be positioned close to the fuel nozzle while a narrower angle allows the oxygen ports to be spaced lower. The oxygen ports are also placed such that oxygen exiting from them will not impinge directly upon the combustion chamber wall. The resultant vortex which is formed will thus tend to stay away from the wall reducing the boundary layer effects on it.

In the preferred embodiment, initial ignition of the fuel-oxygen mixture occurs by the injection of a small amount of a pyrophoric liquid such as triethylaluminum ("TEAL"). The pyrophoric liquid can be injected either through a separate port, or as is presently preferred, it can be injected into the mixing chamber through the fuel nozzle. Injection of the pyrophoric fluid and oxygen are preferably timed such that they reach the reaction chamber simultaneously.

After ignition, the fuel and oxygen continue to burn to provide the heat necessary to form the steam. The vortex flow created by orifice 60 and oxygen inlet ports 34 and 35 creates a stable, high intensity flame which can burn for significant periods of time. Because vortex flames are more compact than other flame configurations, the vortex flames are less likely to be extinguished by pressure fluctuations.

With continued reference to FIG. 1, below mixing chamber 28, the walls of reaction chamber 18 are formed from a sintered stainless steel cylinder 20. The porosity of the sintered cylinder 20 will vary depending upon the amount of heat which is produced by the vortex flame which is a function of the type of fuel which is utilized. (The means of determining the appropriate porosity will be discussed hereinafter.)

The walls of the reaction chamber 18 are kept cool by water passing through the sintered stainless steel cylinder 20. An annulus 40 is formed in housing members 14 and 16 around the outside of sintered cylinder 20, and longitudinal bores 42 and 44 are formed in housing member 14 through which water can flow to fill annulus 40. The upper sections 46 and 48 of bores 42 and 44 are radially enlarged and are connected to a tube (not shown) which travels up the borehole to the surface and is connected to a pump for injecting the water.

The sintered stainless steel cylinder 20 of reaction chamber 18 is sealed from annulus 40 by a gasket 52 at its upper end and by an O-ring 54 positioned in annular groove 56 at the lower end of reaction chamber 18. Thus, the water in annulus 40 cannot go around the ends, but it must pass through cylinder 20 to enter reaction chamber 18.

The porosity of sintered cylinder 20 and the water pressure within annulus 40 are adjusted to establish a water flow rate wherein the majority of water passing through the sintered stainless steel cylinder 20 is vaporized by the radiant heat from the vortex flame to form saturated steam. The remainder of the water flows down the sides of reaction chamber 18 and exits through orifice 60 formed in the bottom of reaction chamber 18. The excess water serves as a safety factor to insure that hot spots do not occur and also serves to cool orifice 60 and the lower portion of reaction chamber 18 which is not formed by the sintered steel cylinder. (The amount of water which must be injected through sintered stainless steel cylinder 20 in order to protect the steam generator can be calculated from simple heat balances equations which are discussed in greater detail hereinafter.)

Because all of the water is not vaporized, the temperature of the walls of reaction chamber 18 are maintained below the temperature of saturated steam at the operating pressure thus protecting them from extreme heat. For example, if steam generator 10 is operated under 100 psia of pressure, the walls of reaction chamber 18 will be below about 300° F. while the flame temperature is about 5000° F.

It is important that the porosity of sintered cylinder 20 be uniform to insure that water flows through the cylinder evenly to avoid hot spots which would occur if one area became dry. Additionally, it is important to prevent sintered cylinder 20 from becoming plugged by material contained in the water. Thus, the water which is pumped into annulus 40 is preferably filtered and deionized at the surface before injection into the steam generator.

In use, injection of the cooling water is timed such that it reaches steam generator 10 before injection of the oxygen and fuel occur. After the water flow has equilibrated, the oxygen and pyrophoric liquid can be injected, and the flame ignited. If the flame were ignited before water began flowing through the sintered stainless steel cylinder 20, the intense heat from the flame could easily damage steam generator 10.

The sintered stainless steel cylinder which forms the interior wall of the cooling system for the combustion chamber provides a significant advancement over the prior art devices. Inasmuch as cooling water enters the combustion chamber through substantially the entire surface of the walls, the likelihood that dry spots, and thus hot spots, will occur is decreased. Accordingly, the likelihood that the steam generator will be damaged and have to be removed is lessened.

The gases resulting from the combustion of the fuel and the steam generated in the reaction chamber exit through orifice 60 formed in the bottom of reaction chamber 18. Orifice 60 acts to stabilize the flame by presenting an obstacle to the downward flow of gases. While some of the combustion gases exit unimpeded through orifice 60, other combustion gases reverse direction and return axially upward into reaction chamber 18. The result is an intense mixing time which eliminates the need for a much longer reaction chamber.

After leaving reaction chamber 18 through orifice 60, the primary steam and combustion products enter the steam generating section of steam generator 10 which is generally designated at 62. As illustrated in FIG. 1, steam generating section 62 is formed from concentrically spaced cylinders 70 and 72. (In a presently preferred embodiment, cylinder 70 is about nine feet long and is formed from a piece of 3½ inch diameter pipe.) The upper portion of cylinder 70 is threaded at 74 such that it can be screwed into lower housing member 16 of combustion section 12.

Cylinder 72 preferably has an outer diameter equal to the diameter of combustion section 12 and is welded at 73 onto lower housing member 16.

Spray nozzles 78 and 80 are diametrally spaced from each other in cylinder 70 and are located a few inches below orifice 60 to form a water mist to interact with the combustion products. Thus, the hot gases exiting reaction chamber 18 come in contact with atomized water from spray nozzles 78 and 80 as they enter section 62 where the gases vaporize the water to form steam. Additional spray nozzles such as nozzle 84 which is shown positioned in the center of section 62 can be spaced throughout the steam generating section to provide additional water to form steam. Nozzles 78, 80 and 84 are screwed into cylinder 70 so that they can easily be interchanged to provide different flow rates.

Water enters spray nozzles 78, 80, and 84 from annulus 88 which surrounds cylinder 70. The outer surface of annulus 88 is defined by cylinder 72. A ring 90 is positioned between the lower portions of cylinders 70 and 72 to seal the bottom of annulus 88. Ring 90 is welded to the outer surface of cylinder 70 at 91 in the preferred embodiment, and an O-ring 92 is placed in an annular groove 94 formecd in the periphery of ring 90 to seal it to the inner wall of outer cylinder 72. Because the inner cylinder is screwed into 16 and the ring is sealed to 72 by an O-ring, cylinder 70 can be easily removed to change the spray nozzles 78, 80, and 84. This feature extends the operating range of the unit without replacement of the entire unit.

Besides supplying water to nozzles 78, 89, and 84, the water in annulus 88 also serves to cool steam generating section 62 to protect it from the heat of the combustion products.

Figure 5:
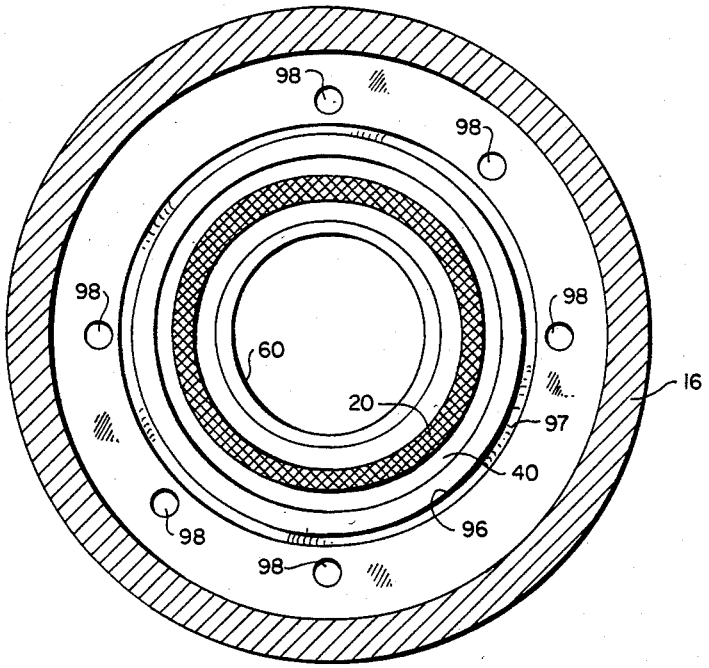
FIG. 5 is a cross-sectional view of the combustion section of the steam generator of the present invention taken at the position indicated by line 5—5 of FIG. 1.

Water enters the top of annulus 88 through a plurality of bores 98 formed in lower housing member 16 of combustion section 12. As shown in FIG. 5, there are six bores 98 in the preferred embodiment down through which water flows into annulus 88. Bores 98 not only serve as conduits for the water to enter annulus 88 but also serve as a means for cooling lower housing member 16. As the water passes through bores 98 which are spaced around housing member 16, the water absorbs the heat transmitted to housing member 16 as the combustion products exit through orifice 60.

Figure 4:
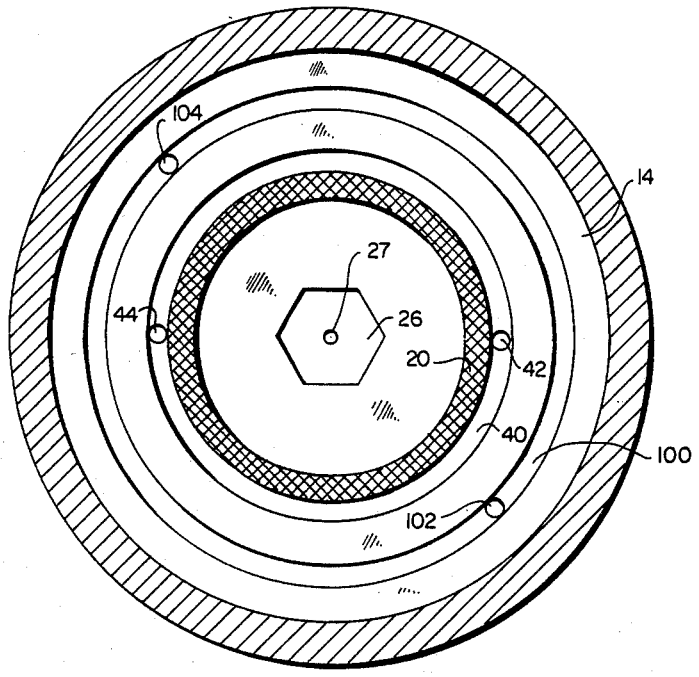
FIG. 4 is a cross-sectional view of the combustion section of the steam generator of the present invention taken at the position indicated by line 4—4 of FIG. 1.

Bores 98 are connected at their upper end to an annulus 100 which is formed in the lower surface of upper housing member 14 (see FIGS. 1 and 4). Water is fed into annulus 100 through longitudinal bores 102 and 104 (see FIGS. 2 and 4) which pass through upper housing member 14 and are enlarged at 103 and 105 where they are connected to a tube (not shown) leading up the borehole to the ground surface which is connected to a pump for injecting the water.

An annular groove 96 is formed in the upper surface of lower housing member 16 between annulus 100 and annulus 40 into which an O-ring 97 is placed. O-ring 97 forms a seal between housing members 14 and 16 to prevent water from flowing between annulus 100 and annulus 40. As discussed previously, the primary water which is pumped into annulus 40 is preferably filtered and deionized to remove any material which could plug sintered cylinder 20. However, it is not as critical, although recommended, to filter and deionize the secondary water in annulus 100 which is used in steam generating section 62, as in the case of the primary water because the nozzles in the steam generating section do not become plugged as easily as the sintered cylinder.

Additionally, the water pressure necessary to force the primary water in annulus 100 through sintered cylinder 20 at the desired flow rate is often times different than the water pressure necessary to force the secondary water through spray nozzles 78, 80, and 84. Accordingly, O-ring 97 isolates the two water supplies and prevents them from intermixing and equalizing pressures.

With further reference to FIG. 1, the steam and the combustion products exit cylinder 70 of steam generating section 62 through one-way valves 106 formed in the lower portion of cylinder 70. Thereafter the steam and combustion products flow into the space 108 between cylinders 70 and 72 below ring 90; they then exist from space 108 through the bottom of the steam generator 10. The steam and combustion products can thereafter enter the hydrocarbon-bearing formation through holes in the well casing. Any water which is not vaporized in steam generating section 62 will be at its saturation temperature and exits through one-way valve 110 positioned in the center of plate 112 which covers and seals the bottom of cylinder 70 and flows into the rock formation.

The one-way check valves 106 and 110 are used to prevent the combustion products and steam from backflushing into the system. This feature also allows the burner to operate at a pressure different from that of the formation. Depending on the cracking pressure of the check valves (the pressure required for flow to occur), the water which exits through one-way valve 110 may become saturated or superheated steam after it exits.

In order to prevent the steam from flowing back up the well casing, the steam generator is preferably sealed to the sides of the well casing. In this preferred embodiment, a packing groove 114 is formed in upper housing member 14 and a packing groove 116 is formed in steam generating section 62 to hold packing material (not shown) to seal generator 10 to the well casing. The basic requirements for a suitable packing material are that it be sufficiently resilient to seal the casing at the temperature of the steam and at the pressure of the formation (this pressure is dependent upon well depth, but is generally about 2500 psia).

As can be seen from the foregoing, the present invention provides a compact, reliable steam generator which can be positioned in boreholes or other confined spaces to generate steam near the point where it is utilized. Additionally, the simple modular construction allows various parts such as the fuel and water spray nozzles to easily be interchanged for different operating conditions.

In order to properly size the various sections of the steam generator and to determine the various flow rates, it is important to establish the amount of heat that is to be released from the steam generator and to choose a stoichiometric ratio for the fuel and oxygen. Any stoichiometric value greater than one can be used, but fuel-rich mixtures tend to produce unburned carbon.

The general equation for heat released by a combustion process is:

$$Q_{Rel}=N_f\Delta H_c+H_R-H_P. \quad (1)$$

where $Q_{REL}$ is the heat released; $N_f$ is the number of moles of fuel; $H_c$ is the heat of combustion for the particular fuel; $H_R$ is the heat content of all reactants; and $H_P$ is the heat content of all products.

In a preferred embodiment of the present invention, a hydrocarbon fuel and oxygen are the reactants and carbon dioxide, steam, and excess oxygen are the products. By knowing the fuel composition and the stoichiometric ratio, equation (1) can be expanded and rearranged to yield the required fuel rate which is:

$$N_f=\frac{Q_{REL}-N_{O_2}H_{O_2}+(n_{CO_2}/N_f)h_{CO_2}+(n_{H_2O}/N_f)h_{H_2O}+(n_{O_2}/N_f)h_{O_2}}{\Delta H_c+H_f} \quad (2)$$

The amount of water that must flow through sintered stainless steel cylinder 20 to form primary steam is dependent upon the flame temperature and operating pressure. For example, if No. 2 oil is used as the fuel and if pure oxygen is used as the oxidant at an operating pressure of 500 psia, the flame temperature will be about 6300° R.

The heat which vaporizes the water entering through the sintered cylinder 20 comes primarily from black-body flame radiation. The radiative heat flux is given by:

$$q=\sigma T^4. \quad (3)$$

where q is the radiative heat flux; $\sigma$ is Boltzmanns Constant; and T is the temperature of the flame. Using a flame temperature of 6300° R and equation (3), the heat flux can be calculated. For a cylinder one and one-half inches in diameter and three inches in length, the heat rate is $2.68\times10^5$ BTU/hr.

The volumetric flow rate of the water must be such that the change in enthalpy as the water is converted from liquid to steam is equal to the heat rate. From steam tables, the enthalpy of steam at 500 psia is determined to be 1204.7 BTU/lbm. If it is assumed that the water enters the system at 25° C. and one atmosphere, then the enthalpy of the liquid water is zero. Although the water enters at pressures much greater than 1 atm, its enthalpy can be assumed to be that at 1 atm and 25° C. Thus, the change in enthalpy is 1204.7 BTU/lbm. Dividing the heat rate of $2.68\times10^5$ BTU/hr. by the enthalpy change of 1204.7 BTU/lbm, the water flow rate is calculated to be 222 lbm/hr or about 26.6 gallons of water per hour.

The equation for determining the porosity of the sintered stainless steel cylinder is derived from Darcy's Equation for flow through a porous medium and yields:

$$\Delta P=\frac{\alpha\mu Q}{2\pi L}\ln(r_o/r_i)+\frac{\beta\rho}{g_c}\left(\frac{Q}{2\pi L}\right)^2\left(\frac{1}{r_i}-\frac{1}{r_o}\right) \quad (4)$$

where $\Delta P$ is the pressure drop across the cylinder; $\alpha$ is the viscous resistance constant for the cylinder; $\mu$ is the viscosity; Q is the water flow rate; L is the length of the cylinder; $r_o$ is the outer radius and $r_i$ is the inner radius of the cylinder; $\beta$ is the inertial resistance constant; $\rho$ is the density of the water; and $g_c$ is the standard gravitational constant.

The pressure drop of equation (4) can be almost any chosen value but it must be greater than the pressure fluctuations of the flame in order to prevent backflow of gases through the cylinder. The remainder of the terms of equation (4) are known for a given sized cylinder, except for $\alpha$ and $\beta$. From specifications of the manufacturer for $\alpha$ and $\beta$ versus porosity, equation (4) can be used to iteratively calculate the desired porosity of the sintered stainless steel cylinder.

The effectiveness of the present invention has been demonstrated by tests which were performed utilizing a one-sixth scale-model steam generator.

During the test runs, No. 2 fuel oil was used to fuel the steam generator and pure oxygen was used as the oxidant. Triethylaluminum was utilized as the pyrophoric liquid to initiate ignition in the steam generator. During these tests, the triethylaluminum was injected through a separate port in the top of the combustion section.

During the runs, the oxygen, primary water, secondary water, and fuel input rates and the steam temperature were all measured. Small portions of gaseous samples were drawn from the products and analyzed for solid carbon, carbon monoxide, carbon dioxide, oxygen, nitrogen oxides, and gaseous water. The operating parameters for two runs are summarized in Table 1 below.

TABLE 1

| Run No. | Operating Pressure (psig) | Net Heat Release (Btu/hr) | Stoichiometric Ratio | Fuel (lb-moles) | Oxygen (lb-moles) | Water (lb-moles) |
|---|---|---|---|---|---|---|
| 1 | 103 | $8.29 \times 10^5$ | 1.34 | 2.08 | 4.05 | 25.18 |
| 2 | 248 | $1.67 \times 10^6$ | 1.25 | 1.95 | 3.53 | 18.67 |

The composition of the final products was calculated from the measurements made on the gaseous samples which were withdrawn. The results of the final product compositions in lb-moles are summarized in Table 2 below.

TABLE 2

| Run No. | C | CO | $CO_2$ | $O_2$ | $H_2O_{(g)}$ | $H_2O_{(l)}$ | Unburned Fuel |
|---|---|---|---|---|---|---|---|
| 1 | 0.00382 | 0 | 1.74 | 1.46 | 20.77 | 6.10 | 0.34 |
| 2 | 0.00181 | 0 | 1.71 | 1.01 | 16.34 | 3.94 | 0.24 |

The combustion efficiencies for runs 1 and 2 were 83.5% and 87.6% respectively. The combustion efficiency was determined by subtracting the solid carbon in the products and carbon in any unburned fuel from the carbon which was injected in the fuel and dividing the results by the total carbon in the fuel and multiplying by 100.

As can be seen from Table 1, the operating pressure during Run No. 2 was 248 psig which was greater than the operating pressure of 103 psig utilized in Run No. 1. As the pressure was increased, it was found that the flame had a tendency to compress itself, thereby allowing greater residence times in the combustion chamber and a smaller effect of the walls on the vortex. As the residence time increased and wall effects decreased, the combustion efficiency, and thus, the quality of steam increased. The quality of steam for Runs 1 and 2 was 77.2% and 80.57% respectively. Theoretically, the best steam qualities which could be obtained were 77.2% and 100% for runs 1 and 2.

While the test results which were obtained did not reach the levels anticipated for a full scale model built in accordance with the teachings of the present invention, the test results do illustrate the effectiveness of the present invention for its intended purpose.

One difference in the scale model used in these tests was that the oxygen inlet ports were positioned immediately below the fuel spray nozzle. This resulted in a decreased momentum being imparted to the vortex flame; thus, some fuel flowed down the combustion walls without reaction and mixed with excess water from the sintered stainless steel cylinder. The lack of momentum also caused a portion of the flame to extend below the orifice in the bottom of the reaction chamber. This portion of the flame was quenched by the water spray in the secondary steam and exhaust section, thereby resulting in the formation of solid carbon which decreased the efficiency of the burner.

A second difference in the model steam generator used in these tests was the porosity of the sintered stainless steel cylinder. The cylinder which was utilized was a stock item from the manufacturer which had a porosity greater than that which was needed according to the above equations. In order to maintain a sufficient pressure drop through the sintered stainless steel cylinder, it was necessary to utilize a flow rate approximately three times greater than the calculated value. This large amount of water made it physically impossible for the water to become steam in the reaction chamber. However, in some of the measurements, the excess water was turned to steam in the secondary steam and exhaust section of the steam generator. It is also believed that the large primary water rate also produced larger amounts of unburned carbon than would have been produced with a lower porosity cylinder.

A third structural difference which was utilized in the scale model was the orientation of the secondary steam and exhaust section. Because of the height of the lab facilities, it was impossible to position all of the secondary steam and exhaust section directly below the combustion section. Accordingly, a portion of the secondary steam and exhaust section was positioned horizontally with respect to the remainder of the steam generator.

As can be seen from the foregoing, the present invention provides an apparatus and method for producing steam which can be used in a borehole near a hydrocarbon-bearing formation which utilizes a vortex-stabilized flame to heat the water and create steam. It is also apparent that the utilization of the porous, sintered cylinder in the present invention provides an effective means of introducing water to form steam and of protecting the walls of the burner chamber. Additionally, it is apparent that the utilization of a pyrophoric liquid to ignite the flame in the burner provides a reliable method for initiating combustion.

While the present invention has been described with reference to the presently preferred embodiment as illustrated in FIGS. 1 to 5, the invention may be embodied in other specific forms without departing from its spirit or essential characteristics. The described embodiment is, therefore, to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and is desired to be secured by U.S. Letters Patent is:

1. An apparatus for producing steam in a confined area, said apparatus comprising:

a combustion section with a reaction chamber forming a part thereof, said combustion section having means for mixing fuel and oxygen such that a vortex-stabilized flame is formed within said reaction chamber during combustion;

an orifice positioned below said reaction chamber;

means for cooling the walls of the reaction chamber around the flame, said cooling means comprising porous sintered material forming a portion of the walls of the reaction chamber above the orifice such that water can flow through the sintered material; and means for combining water with combustion products from the reaction chamber such that the combustion products can vaporize the water to form steam.

2. An apparatus for producing steam as defined in claim 1 wherein the mixing means comprises a fuel inlet port positioned such that fuel exiting therefrom axially enters the reaction chamber and a plurality of oxygen inlet ports positioned such that the oxygen tangentially enters the reaction chamber.

3. An apparatus for producing steam as defined in claim 2 wherein the plurality of oxygen inlet ports comprises two ports which are positioned below the fuel inlet port and are diametrially positioned with respect to each other in the periphery of the reaction chamber.

4. An apparatus for producing steam as defined in claim 1 wherein said orifice has a diameter smaller than the diameter of the reaction chamber so as to reinforce the vortex-stabilized flame in the reaction chamber.

5. An apparatus for producing steam as defined in claim 1 wherein the combining means comprises a steam generating section positioned below the combustion section.

6. An apparatus for producing steam as defined in claim 5 wherein the steam generating section is formed from two concentric cylinders having an annular space formed therebetween.

7. An apparatus for producing steam as defined in claim 6 wherein the steam generating section comprises a plurality of nozzles formed in the sides of the inner of the concentric cylinders to form a water mist therein which can be vaporized by combustion products exiting from the combustion section.

8. An apparatus for producing steam as defined in claim 6 further comprising means by which water can pass around the combustion section and into the annular space between the concentric cylinders in the steam generating section.

9. An apparatus for producing steam as defined in claim 1 wherein said sintered material comprises a cylinder.

10. An apparatus for producing steam as defined in claim 9 wherein said porous, sintered cylinder is formed from stainless steel.

11. An apparatus for producing steam as defined in claim 9 further comprising an annular space surrounding the porous cylinder.

12. A down-hole steam generator for producing steam for injection into a hydrocarbon-bearing formation, said apparatus comprising:

a combustion section, with a reaction chamber forming a part thereof, said combustion section having a fuel inlet port in the top thereof such that fuel exiting from said fuel port axially enters the reaction chamber and a plurality of oxygen inlet ports positioned in the sides of said reaction chamber such that oxygen exiting therefrom tangentially enters the reaction chamber to from a generally vortex-like flow;

an orifice positioned below said reaction chamber;

means for cooling the walls of the reaction chamber during combustion to protect them from heat created during combustion, said cooling means comprising a porous, sintered cylinder forming a portion of the sides of the reaction chamber above the orifice such that water can flow through the cylinder; and means for combining water with combustion products from the reaction chamber such that the combustion products can vaporize the water to form steam.

13. An apparatus for producing steam as defined in claim 12 wherein said porous, sintered cylinder is formed from stainless steel.

14. An apparatus for producing steam as defined in claim 12 further comprising an annular space surrounding said porous cylinder.

15. An apparatus for producing steam as defined in claim 12 wherein said orifice has a diameter smaller than the diameter of the reaction chamber so as to reinforce the vortex-stabilized flame in the reaction chamber.

16. An apparatus for producing steam as defined in claim 12 wherein the combining means comprises a steam generating section positioned below the combustion section.

17. An apparatus for producing steam as defined in claim 16 wherein the steam generating section is formed from two concentric cylinders having an annular space formed therebetween.

18. An apparatus for producing steam as defined in claim 17 wherein the steam generating section comprises a plurality of nozzles formed in the sides of the inner of the concentric cylinders to form a water mist therein which can be vaporized by combustion products exiting from the combustion section.

19. An apparatus for producing steam for injection into a hydrocarbon-bearing formation, said apparatus comprising:

a combustion section, said combustion section comprising:

a cylindrical housing having a bore extending axially therethrough to form a reaction chamber in which fuel can be combusted with oxygen; and a porous cylinder through which water can flow to cool the combustion section, said cylinder being positioned within the bore in said housing such that an annular space is formed between the housing and the porous cylinder; and an orifice positioned below said reaction chamber; and a steam generating section positioned below said combustion section wherein combustion products formed in the combustion section can vaporize water to form steam.

20. An apparatus for producing steam as defined in claim 19 wherein the porous cylinder is formed from sintered stainless steel.

21. An apparatus for producing steam as defined in claim 19 wherein the combustion section further comprises a fuel nozzle positioned in the top thereof such that fuel exiting from said nozzle axially enters the reaction chamber.

22. An apparatus for producing steam as defined in claim 21 wherein said combustion section further comprises a plurality of oxygen inlet ports positioned below said fuel nozzle such that oxygen exiting therefrom tangentially enters the reaction chamber such that a vortex flow is created by the oxygen.

23. An apparatus for producing steam as defined in claim 20 wherein said orifice has a diameter smaller than the diameter of the reaction chamber.

24. An apparatus for producing steam as defined in claim 19 wherein the steam generating section is formed from two concentrically spaced cylinders having an annular space formed therebetween.

25. An apparatus for producing steam as defined in claim 24 wherein the steam generating section comprises a plurality of nozzles formed in the sides of the innermost of the concentric cylinders to form a water mist which can be vaporized by combustion products exiting form the combustion section.

26. A down-hole steam generator for producing steam for injection into a hydrocarbon-bearing formation, said apparatus comprising:

a combustion section comprising:

a cylindrical housing sized such that it is positionable within a well casing, said housing having a bore extending axially therethrough to form a reaction chamber in which fuel can be combusted with oxygen;

a porous, sintered stainless steel cylinder forming a portion of the sides of the reaction chamber through which water can flow to cool the reaction chamber, said cylinder being positioned within the bore in said housing such that an annular space is formed between the housing and the porous, sintered stainless steel cylinder;

an orifice positioned below said reaction chamber; and a steam generating section positioned below said combustion section wherein combustion products formed in the combustion section can vaporize water to form steam.

27. An apparatus for producing steam as defined in claim 26 wherein the combustion section further comprises a fuel nozzle positioned in the top thereof such that fuel exiting from said nozzle axially enters the reaction chamber.

28. An apparatus for producing steam as defined in claim 27 wherein said combustion section further comprises a plurality of oxygen inlet ports positioned below said fuel nozzle such that oxygen exiting therefrom tangentially enters the reaction chamber such that a vortex flame is created by the oxygen.

29. An apparatus for producing steam as defined in claim 29 wherein said orifice has a diameter smaller than the diameter of the reaction chamber so as to reinforce the vortex flame in the reaction chamber.

30. An apparatus for producing steam as defined in claim 26 wherein the steam generating section is formed from two concentrically spaced cylinders having an annular space formed therebetween.

31. An apparatus for producing steam as defined in claim 30 wherein the steam generating section comprises a plurality of nozzles formed in the sides of the innermost of the concentric cylinders to form a water mist which can be vaporized by combustion products exiting form the combustion section.

32. A down-hole steam generator for producing steam for injection into a hydrocarbon-bearing formation, said apparatus comprising:

a combustion section, said combustion section comprising:

a cylindrical housing having a bore extending axially therethrough to form a reaction chamber in which fuel can be combusted with oxygen;

a porous, sintered stainless steel cylinder through which water can flow to cool the reaction chamber, said porous cylinder forming a portion of the walls of the reaction chamber and being positioned within the bore in said housing such that an annular space is formed between the housing and the porous, sintered stainless steel cylinder;

a fuel nozzle positioned in the top of said combustion section such that fuel exiting therefrom axially enters the reaction chamber;

a plurality of oxygen inlet ports positioned in said combustion section such that oxygen exiting therefrom tangentially enters the reaction chamber such that it can form a generally vortex-like flow;

an orifice positioned below said reaction chamber; and a steam generating section positioned below the combustion section wherein combustion products formed in the combustion section can vaporize water to form steam.

33. A method for producing steam in a down-hole steam generator having a combustion section and a steam generating section, said combustion section having a reaction chamber, said combustion section having means for mixing fuel and oxygen such that a vortex-stabilized flame is formed within said reaction chamber during combustion, an orifice positioned below said reaction chamber, and means for cooling the walls of the reaction chamber around the flame, said cooling means comprising porous sintered material forming a portion of the walls of the reaction chamber above the orifice such that water can flow through the sintered material, the method comprising the steps of:

axially injecting fuel into the reaction chamber through a spray nozzel;

tangentially introducing oxygen into the reaction chamber such that it mixes with the fuel to form a substantially vortex-like flow in the combustion section;

igniting the fuel and oxygen such that combustion occurs; and intermixing water with the combustion products in the steam generating section to form steam.

34. A method for producing steam as defined in claim 33 wherein the igniting step comprises introducing a pyrophorix liquid into the reaction chamber to initiate combustion.

35. A method for producing steam in a down-hole steam generator having a combustion section said combustion section comprising a reaction chamber, said combustion section having means for mixing fuel and oxygen such that a vortex-stabilized flame is formed within said reaction chamber during combustion, an orifice positioned below said reaction chamber, and means for cooling the walls of the reaction chamber around the flame, said means comprising porous sintered material through which water can flow, said sintered material forming a portion of the walls of the reaction chamber above the orifice and a steam generating section positioned below the combustion chamber, said method comprising the steps of:

injecting fuel into the combustion chamber through a spray nozzle;

introducing oxygen into the combustion chamber such that the oxygen interacts with the fuel to form a generally vortex-like flow:

combusting the fuel and oxygen;

passing water through the porous stainless steel cylinder to cool the sides of the combustion and to form steam; and intermixing water with the combustion products in the steam generating section to form steam.

36. A method for producing steam as defined in claim 35 wherein the combusting step further comprises introducing a pyrophoric liquid into the combustion chamber to initiate combustion.

37. A method for producing steam as defined in claim 35 wherein the steam generating section has a plurality of water spray nozzles positioned therein and wherein the intermixing step comprises pumping water through the spray nozzles to form a water mist.

* * * * *

UNITED STATES PATENT AND TRADEMARK OFFICE

CERTIFICATE OF CORRECTION

PATENT NO. : 4,558,743

DATED : December 17, 1985

INVENTOR(S) : NORMAN W. RYAN et al.

It is certified that error appears in the above-identified patent and that said Letters Patent is hereby corrected as shown below:

Column 1, line 27, "effect" should be --affect--
Column 1, lines 33-34, often times" should be --oftentimes--
Column 1, line 48, "Often times" should be --Oftentimes--
Column 5, line 3, "rubblized" should be --rubbilized--
Column 5, line 27, "symetric" should be --symmetric--
Column 7, line 14, "occur" should be --occurs--
Column 8, line 12, "89" should be --80--
Column 8, line 52, "often times" should be --oftentimes--
Column 13, line 57, "to from" should be --to form--
Column 14, line 42, "a steam generating section" should be preceded by a new subparagraph
Column 15, line 4, "form the" should be --from the--
Column 15, line 49, "form the" should be --from the--
Column 16, line 23, "nozzel" should be --nozzle--
Column 16, line 36, "section said" should be --section, said--

Signed and Sealed this

*Fifteenth* Day of *April 1986*

[SEAL]

*Attest:*

DONALD J. QUIGG

*Attesting Officer*

*Commissioner of Patents and Trademarks*